US008684714B2

(12) United States Patent
Leonard

(10) Patent No.: US 8,684,714 B2
(45) Date of Patent: Apr. 1, 2014

(54) INTERNAL ORBITAL ENGINE

(76) Inventor: Frank W. Leonard, Marsing, ID (US)

( * ) Notice: Subject to any disclaimer, the term of this patent is extended or adjusted under 35 U.S.C. 154(b) by 0 days.

(21) Appl. No.: 13/604,454

(22) Filed: Sep. 5, 2012

(65) Prior Publication Data

US 2014/0065001 A1 Mar. 6, 2014

(51) Int. Cl.
*F03C 2/00* (2006.01)
*F03C 4/00* (2006.01)
*F04C 2/00* (2006.01)

(52) U.S. Cl.
USPC ..... 418/259; 418/61.1; 123/243; 123/245

(58) Field of Classification Search
USPC ..... 418/259–260; 123/243, 245–246
See application file for complete search history.

(56) References Cited

U.S. PATENT DOCUMENTS 3,447,513 A * 6/1969 Schneider ..... 123/245
3,452,725 A * 7/1969 Kelly ..... 123/243
4,097,205 A * 6/1978 Miles ..... 123/243
4,848,296 A 7/1989 Lopez
4,915,071 A 4/1990 Hansen
6,065,289 A * 5/2000 Phillips ..... 418/61.1
6,368,089 B1 4/2002 Frolik
6,550,442 B2 4/2003 Garcia
7,350,501 B2 4/2008 Watkins et al.
7,631,632 B2 12/2009 Arov

* cited by examiner

*Primary Examiner* — Theresa Trieu
(74) *Attorney, Agent, or Firm* — Pedersen and Company, PLLC; Ken J. Pedersen; Barbara S. Pedersen

(57) ABSTRACT

An orbital engine with a first outer generally tubular body with a first axis, and a second generally tubular inner orbiter body with a second axis, the second inner body being moveable within the first outer body. The first and second axes are parallel, but not colinear. The second inner body revolves, but does not rotate, within the first outer body Vanes extending generally radially relative to both the inner and outer bodies define multiple chambers in the space between the outside of the inner body and the inside of the outer body. The vanes reciprocate relative to both the inner and outer bodies, and no vane traverses the entire inner surface of the outer body. When fitted with ports in the outer body and valves, the orbital engine may be implemented as an internal combustion engine, gas compressor, liquid pump, air motor, blower, fan or turbine, etc.

10 Claims, 10 Drawing Sheets

INTERNAL ORBITAL ENGINE

BACKGROUND OF THE DISCLOSED TECHNOLOGY

1. Field of the Disclosed Technology

This invention relates generally to internal combustion engines. More specifically, this invention relates to an orbiting rotary internal combustion engine having an outer shell that is generally tubular in shape, and an inner, also generally tubular body, the axis of which inner body is offset, but parallel, to the axis of the outer shell. In operation, the inner body orbits, but does not rotate, around the axis of the outer shell.

2. Related Art

U.S. Pat. No. 4,848,296 (Lopez) discloses an internal combustion engine with an internal orbital rotor. Several stepped crankshafts rotatably connected to the rotor pass through the engine casing. This engine has radial vanes which extend from an axis of the outer engine casing to form seals against the inner surface of the casing.

U.S. Pat. No. 4,915,071 (Hansen) discloses an orbital internal combustion engine with a first, primary internal eccentric, body within a housing. The primary body contains a pair of secondary eccentric bodies spaced apart from the primary body. The housing of this engine has a cylindrical internal wall.

U.S. Pat. No. 6,368,089 (Frolik) discloses a rotary engine with an eccentric rotor mounted in the stator housing for rotation about an eccentric axis parallel to and transversely offset from the central axis of the stator housing.

U.S. Pat. No. 6,550,442 (Garcia) discloses a four-cycle rotary combustion engine/compressor/vacuum pump/steam engine/water motor with a main stationary cylinder and an internal rotor which rotates about a fixed rotor axis. Slidable vanes are anchored at the center of the main cylinder, and divide the interior of the main cylinder into increasing and decreasing spaces as the rotor rotates.

U.S. Pat. No. 7,350,501 (Watkins et al.) discloses a rotary engine with three rotating members that orbit about the center of the rotor. The outer tips of the three rotating members engage the lobes and circular cutouts in the rotor as the rotor rotates.

U.S. Pat. No. 7,631,632 (Arov) discloses an orbital internal combustion engine/pump having two inside impellers with radial vanes within each of several torodial cylinders.

SUMMARY OF THE DISCLOSED TECHNOLOGY

This disclosed technology is for an internal combustion engine that is very compact and relatively light weight and has some resemblance to the current rotary engines. However, this disclosed technology has many features that are different from the rotary engines and that are unique.

This disclosed technology includes an outer body, or shell, that is more or less tubular in shape and has a cross-section that is likely to be circular or polygonal. Inside this tubular shape is another more or less tubular body, the axis of which is offset from the axis of the outer tubular body, but parallel to it. This inner body is known as the orbiter, because it revolves, without rotating, in an orbit around the axis of the outer body. The orbiter may have a cross-section that is circular or polygonal in shape. A crank with one, inner end is centered on the axis of the orbiter, and extends from each end of the orbiter. This crank on its other, outer end is rigidly connected to a drive sprocket, which drive sprocket is centered on the axis of the outer tubular body. The orbiter may have a counterweight added to it to exactly balance the weight of the orbiter and thus eliminate vibration. All of these parts are mounted in such a way that their relationship to each other is controlled throughout the operation of the engine.

In operation, the orbiter revolves about the axis of the outer body without rotating on its own axis. In other words, as the orbiter revolves about the axis of the outer body, a line drawn on the end of the orbiter in a way that coincides with a diameter of the orbiter will remain parallel to itself throughout the orbiter's orbit about the axis of the outer body. In revolving this way, the orbiter causes the cranks at both ends of its axis to turn the drive sprocket, from which sprocket power can be applied to whatever device the engine is driving or being driven by. So, the orbiter revolves about the axis of the outer body in an orbit within the outer body, and does not rotate.

The space between the outside of the orbiter and the inside of the outer body is divided into individual combustion chambers. The chambers are separated from each other by vanes extending generally radially relative to the orbiter and the outer body. Vanes may be mounted in several ways. Typically, the vanes fit snugly into slots, which slots may be placed in the outer body so that the vanes sliding in and out in the slots may be held against the outside surface of the orbiter with springs, or oil pressure, or by other devices. In this embodiment, the vanes may extend to the outside of outer body 12. Alternatively, the slots may be placed in the orbiter in such a way that the vanes sliding in and out relative to the orbiter within the slots are pressed against the inner surface of the outer body. Alternatively, the vanes may telescope in and out within themselves to allow for operational changes in distance between the outer surface of the orbiter and the inner surface of the outer body. Also, lubricating oil may be provided so that it moves alongside or from within the vanes to the inside surface of the outer body.

The vanes are also positioned so that the orbiter can slide back and forth along the length of the vanes as the orbiter revolves inside the outer body. Thus, the spaces between the outer surface of the orbiter and the inner surface of the outer body, and between the vanes which are confined at each end by an end cap on the outer body, constitute engine chambers. The volume of each of these engine chambers varies from near zero to the maximum volume as the orbiter revolves within the outer body. For an internal combustion embodiment, the ignition of compressed vaporized fuel in the engine chambers when the volume is smallest plus fuel and air are present produces an expansive force that forces the orbiter to revolve and turn the cranks at each end, which in turn cause the drive sprockets to rotate. In this internal combustion embodiment, then, the engine chambers are combustion chambers.

The locus of the centroid of each of these combustion chambers would form a circular orbit of its own, which would be the same size as the circular orbit of the centroid of the orbiter as it revolves about the axis of the outer body. These combustion chambers would not revolve about either the axis of the orbiter or the axis of the outer body, but instead would oscillate back and forth between the vanes as the orbiter revolves.

Valves, of course, would be provided and made to open and close in concert with the revolutions of the orbiter. When the combustion chamber is reduced to its minimum volume, a valve in the chamber would be opened so that a vaporized fuel-air mixture would be provided into the combustion chamber. Then, when the chamber was at maximum volume, the first valve would close so that the combustion chamber was completely enclosed. Then the volume of the chamber would again be compressed to the minimum, at which point ignition of the fuel mixture would be produced, for example, by a spark plug. Full expansion of the volume of the combustion chamber would then take place. At that instant, a second valve would open to allow the fumes of the burned fuel to be expelled from the chamber by the following contracting volume of the chamber. This would complete the cycle for the combustion chamber and the process would then be repeated.

The best location for these valves would probably be in the end caps of the outer body, especially if the intake valves were placed in one end cap and the exhaust valves were placed in the other end cap.

Basically, the orbiter is the only significant moving part in the engine. The vanes also move and so do the valves, but their movement is relatively minor.

As the orbiter revolves within the outer body, the combustion cycles of each of the combustion chambers would begin as soon as the chamber ahead of that chamber in firing sequence has completed the first step of its cycle.

This orbital engine could be made with any number of combustion chambers. If the engine contains an even number of combustion chambers, then the engine will be limited to a two-cycle operation. If the engine contains an odd number of combustion chambers, then it may be used with either a two-cycle or a four-cycle operation.

The volumes of the chambers can be varied simply by changing the axial length of the entire engine. If the engine length is doubled, but nothing else is changed, the volume of the individual combustion chambers will also be doubled, and, of course, the horsepower would likewise be doubled. If the length were increased significantly, then each chamber might require two, or more, spark plugs to operate simultaneously and be placed at optimum points of the engine's length, in order to provide optimum ignition of the fuel-air mixture.

Of course, the volumes of the chambers can also be increased by increasing proportionately the diameters of the outer body and the orbiter. Thus, by varying either or both of the engine length and/or the engine and/or orbiter diameter, a very large variety of engine weights and sizes can be achieved.

Any number of different kinds of water jackets, for example, may be provided for this engine to enable adequate cooling of the engine while it is running. Other internal combustion engine accessories that are similar to those in common use can readily be adapted to function with this engine, such as fuel pumps, distributors, carburetors, fuel injectors, valves, combustion chamber seals, water pumps, electric generators, and many other accessories that are normally used on conventional internal combustion engines.

One advantage of this orbital engine design is that the vanes do not rotate around the full perimeter of the inside surface of the outer body, as they are required to do in many other, current rotary-type engines. Thus the distance the end of a given vane must travel for each revolution of the orbiter is much shorter than in a conventional rotary-type engine, and therefore the relative speed of the end of the vane is slower than in a currently available rotary-type engine. This will have the effect, for example, of reducing the friction produced by the vane ends in contact with the inside surface of the outer body.

Another advantage of this engine design over conventional internal combustion engines is that this engine design eliminates the connecting rods and their associated bearings, the crank shaft and its associated bearings, much of the engine block and the crank case, and the pistons, all of which are required in conventional reciprocating internal combustion engines. This makes possible a significant reduction in the weight of this orbital engine as compared with the weight of a conventional engine. Thus, the ratio of the horsepower to the engine weight should be as good as, and perhaps better than, the ratio for currently available rotary-type engines, and significantly better than the ratio for conventional piston-type reciprocating internal combustion engines.

Two or more of these engines could easily be connected end to end axially to increase the total power that could be applied to the drive sprockets. If clutches were provided between the engines thus connected to each other, the power being applied to the drive shaft could be varied in operation when extra power is needed, and disengaged when the extra power is no longer needed.

Also, it would be relatively easy to convert this engine to function as a compressor, pump, steam engine, air motor, blower, or turbine, and for other purposes.

Therefore, this engine design may offer worthwhile advantages over other engines that are now available, and this design may constitute a valuable addition to the arsenal of power units that are now available on the market.

DETAILED DESCRIPTION OF SEVERAL EMBODIMENTS OF THE DISCLOSED TECHNOLOGY

Referring to the Figures, there are shown several, but not all, embodiments of the disclosed technology.

Figure 1:
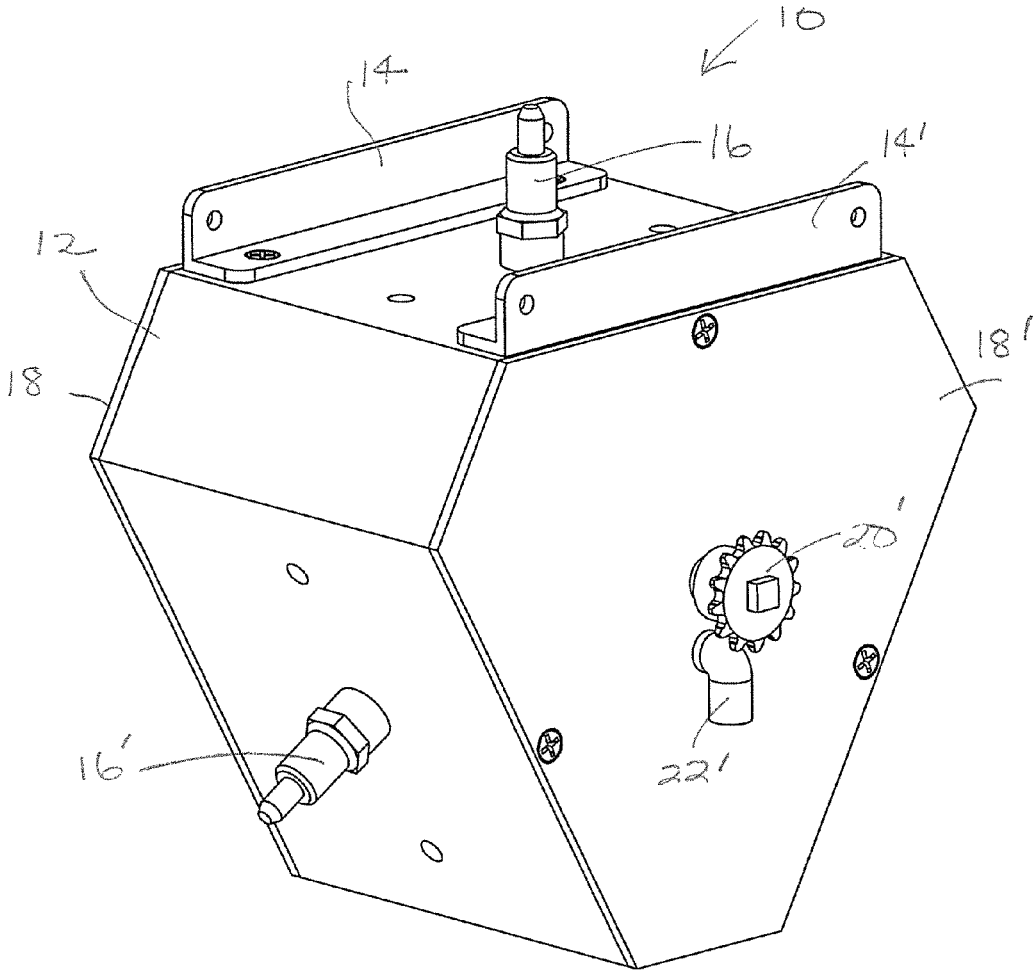
FIG. 1 is a top, side perspective view of one embodiment of the disclosed technology.

FIG. 1 depicts one embodiment 10 of the orbital engine of the disclosed technology. Engine 10 in this perspective view has outer body 12, engine mounts 14 and 14' and spark plugs 16 and 16'. Also in this view, engine 10 has end caps 18 and 18', drive sprocket 20' and circulating oil fitting 22'. Outer body 12 may be made with interconnected steel plates (as shown) for example. Alternatively, outer body 12 may also be from an aluminum or steel casting, for example.

Figure 2:
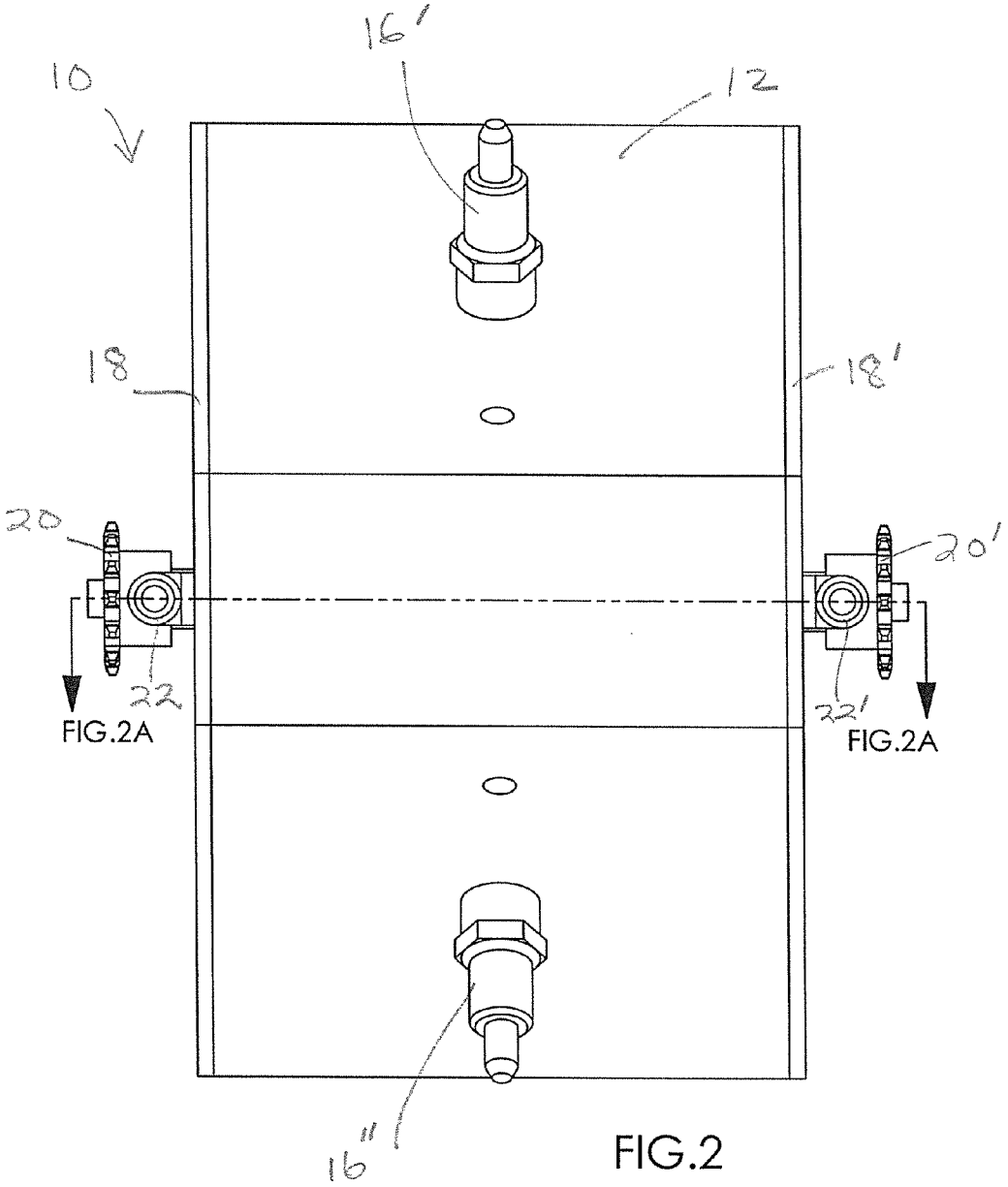
FIG. 2 is a bottom view of the embodiment depicted in FIG. 1.

FIG. 2 depicts the bottom of engine 10 with outer body 12, end caps 18 and 18', drive sprockets 20 and 20', circulating oil fittings 22 and 22' spark plug 16', and newly visible third spark plug 16".

Figure 2A:
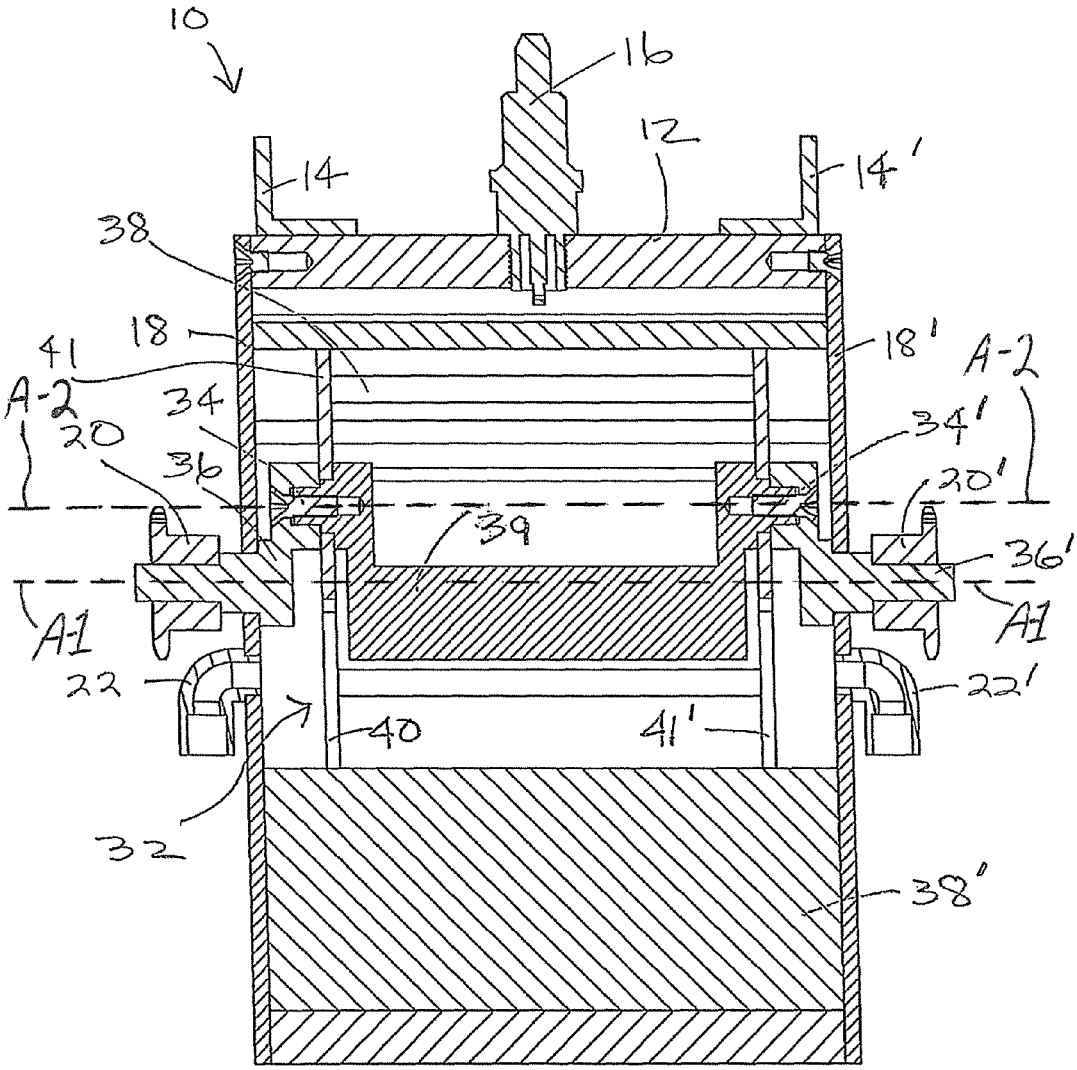
FIG. 2A is a side, cross-sectional view along line 2A-2A in FIG. 2.

FIG. 2A depicts engine 10 in cross-section with outer body 12, engine mounts 14 and 14' spark plug 16, end caps 18 and 18', drive sprockets 20 and 20' and circulating oil fittings 22 and 22'. This Figure also depicts inner orbiter 32 with its center axes 34 and 34', crank arms 36 and 36', and vanes 38 between the outside of inner orbiter 32 and the inside of outer body 12. FIG. 2A also depicts counter-weight 39 which helps minimize vibration of the engine 10 during revolutions by orbiter 32. Outer body 12 has first axis A-1, and inner orbiter 32 has second axis A-2 as shown in this Figure.

Circulating oil fittings 22 and 22' indicate part of a moving oil system which may be present for engine cooling and lubrication. These fittings would be connected, in conventional manner, to an oil pump, filter and conduits, for example, in a circulating oil system. As a result of this circulating oil system, the inside volume of orbiter 32, and the volume on both end sides of orbiter 32 between it and the inside of end caps 18 and 18' are provided with circulating oil for cooling and/or lubrication. This requires that the lateral side edges of orbiter 32 and vanes 38 make an oil-tight seal with the end caps 18 and 18', even under the relatively high pressures expected within the combustion chambers between the outside of orbiter 32 and the inside of outer body 12.

Figure 3:
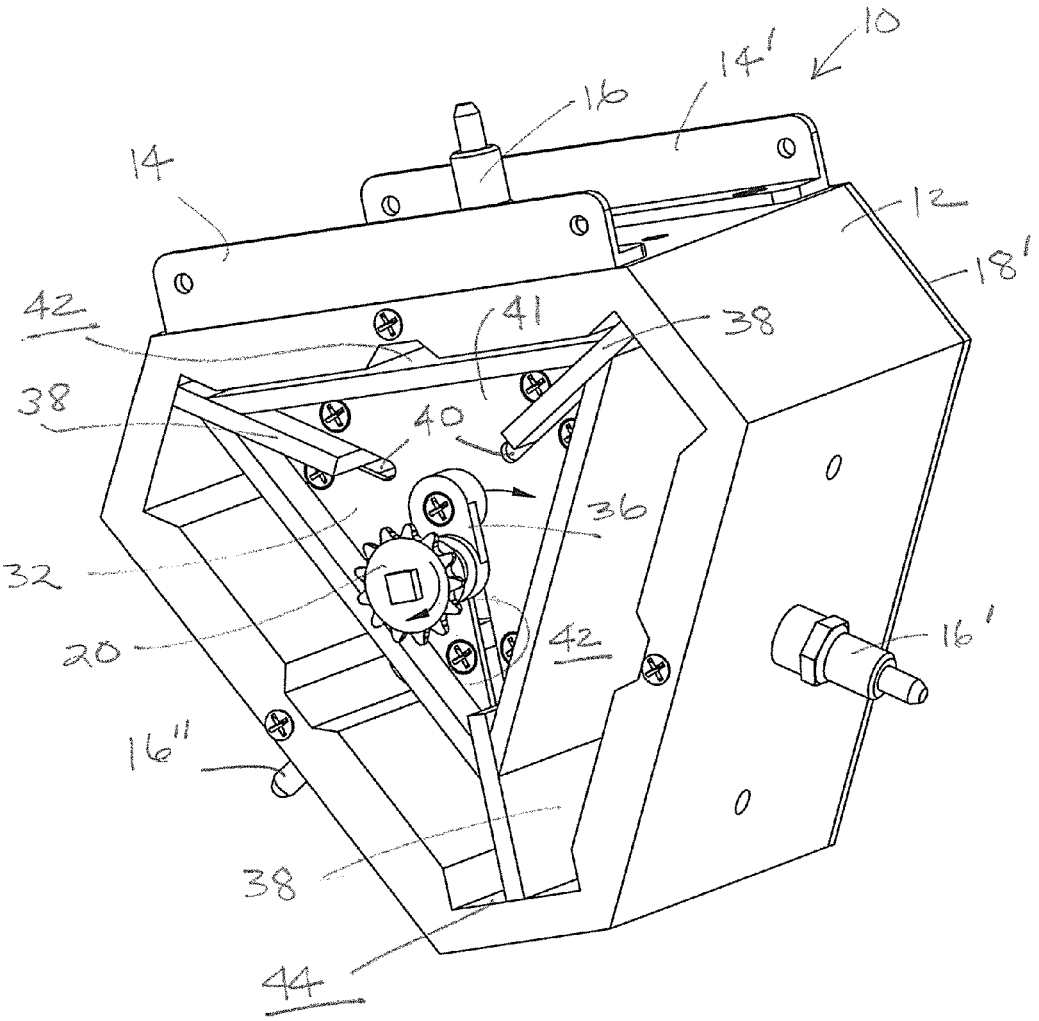
FIG. 3 is a side perspective view of the embodiment depicted in FIG. 1, but with one end cap of the engine outer body removed for illustrative purposes.

FIG. 3 depicts orbital engine 10 with outer body 12, engine mounts 14 and 14', spark plugs 16, 16' and 16", end cap 18' (end cap 18 has been removed for this FIG. 3), drive sprocket 20, inner orbiter 32, crank 36 and three vanes 38. In this case, orbiter 32 is triangular, so it has three flat outer surfaces, two of which are visible in this FIG. 3 and labeled as 42. Vanes 38 reciprocate on flat axial surfaces 44 machined into the inner surface of outer body 12. In this FIG. 3, the top flat outer surface 42 at the top of orbiter 32 is closest to the inside surface of outer body 12, making the "cylinder" space here the minimum volume. The engine 10 with the top "cylinder" space at this point plus with fuel and air compressed therein is in the "chamber 1 firing position" herein.

Figure 4:
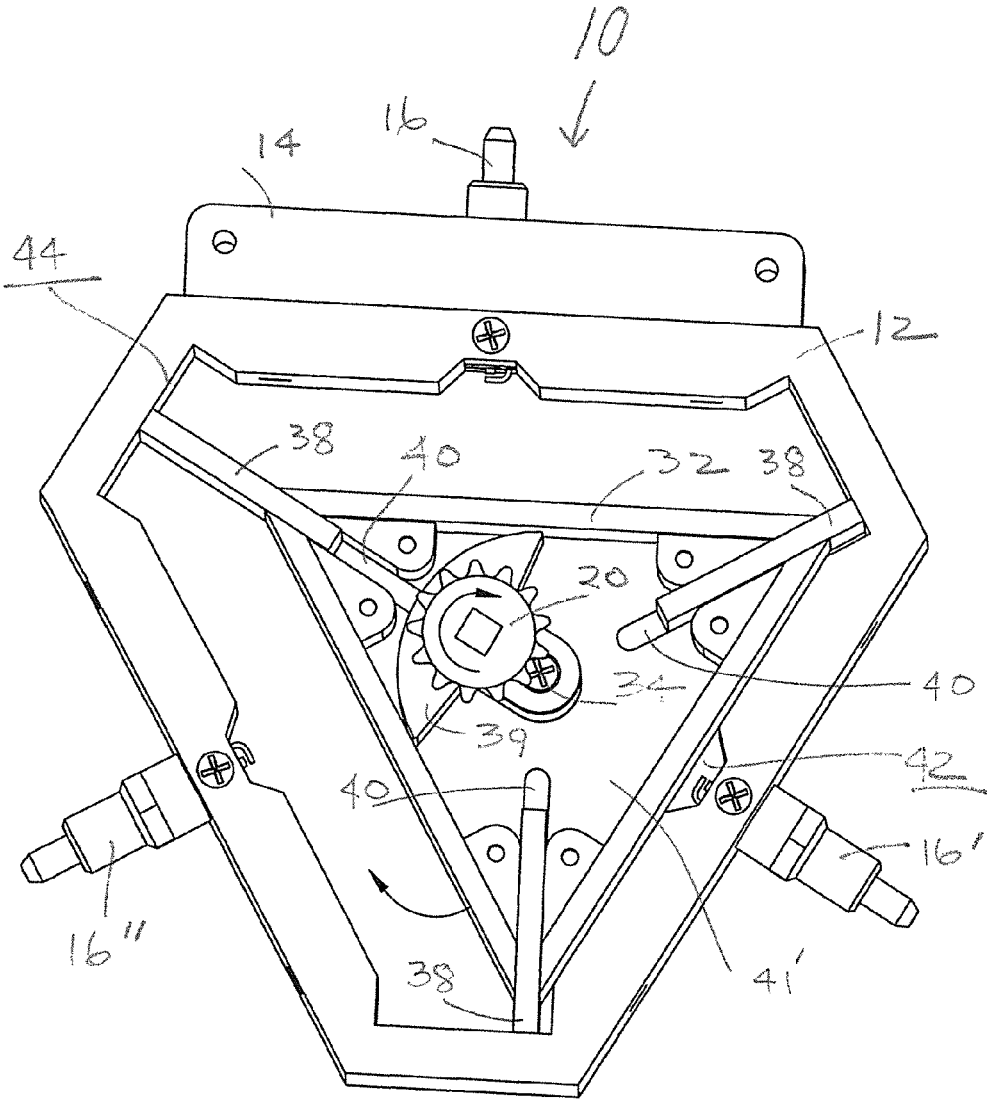
FIG. 4 is a side view of the view depicted in FIG. 3, but with one end plate of the internal orbiter removed for illustrative purposes, and with the orbiter advanced clockwise in its revolution about 120°.

FIG. 4 depicts engine 10 as in FIG. 3, but in a side view, and with the orbiter 32 advanced clockwise about 120° about its center axis 34 (the arrow shows the resulting direction of rotation of drive sprocket 20). In this FIG. 4, all spark plugs 16, 16' and 16" are visible. Also, vanes 38 have moved in FIG. 4, compared to FIG. 3, by sliding in and out relative to the orbiter 32 within their slots 40, and back and forth along flat surfaces 44 in the inner surface of outer body 12. Also, in this FIG. 4, the right side flat outer surface 42 of orbiter 32 is closest to the inside surface of outer body 12, making the "cylinder" space here the minimum volume. The engine 10 with the right side "cylinder" space at this point plus with no fuel or air present is in the "chamber 2 empty position" herein.

Figure 5:
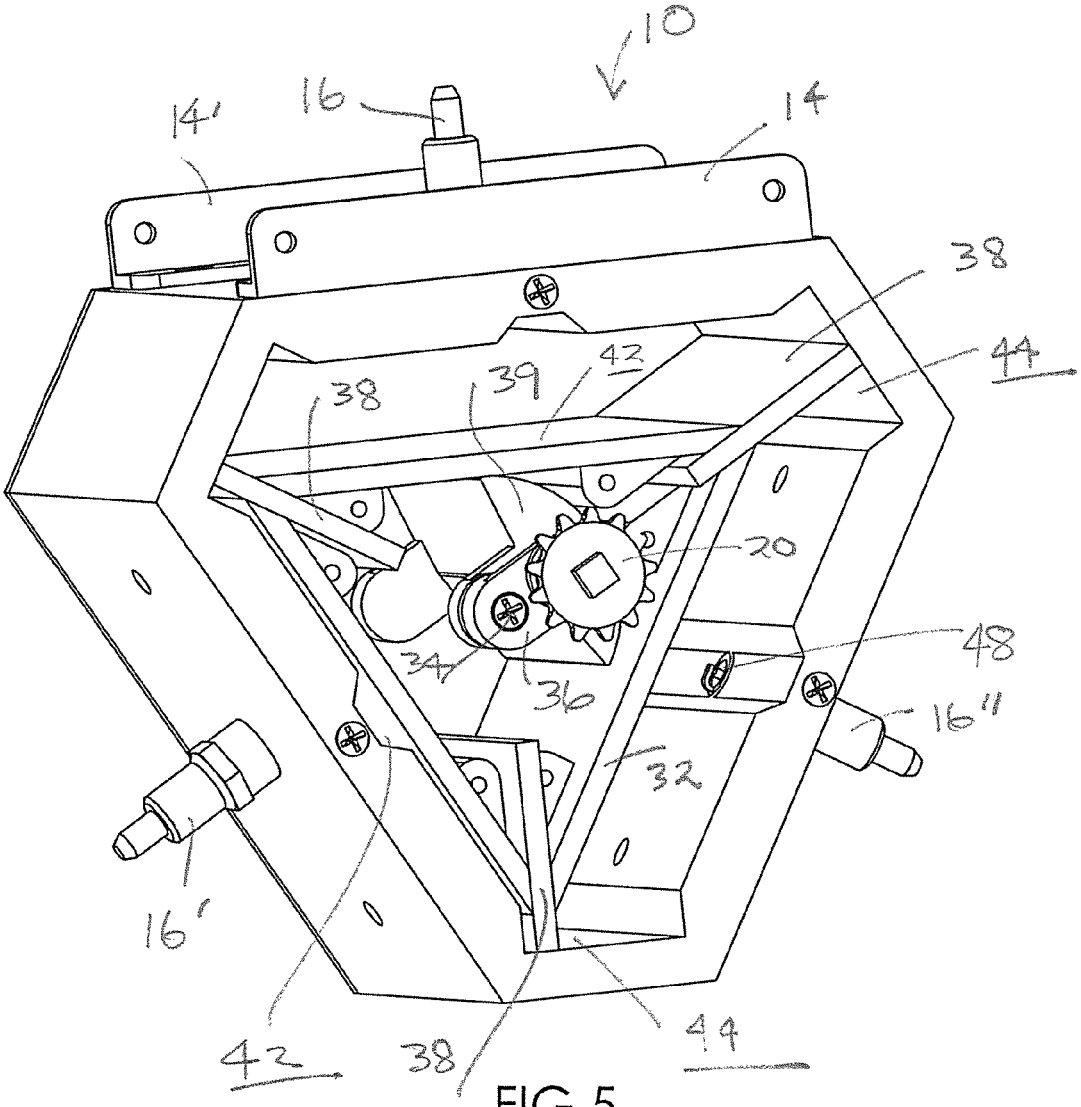
FIG. 5 is a side, perspective view of the view depicted in FIG. 4, but with the orbiter advanced clockwise about another 120°.

FIG. 5 depicts engine 10 as in FIG. 4, but in a side perspective view, and with the orbiter 32 advanced clockwise a further approximate 120° about its center axis 34, compared to FIG. 4. Also, it can seen that counterweight 39 has advanced clockwise about 120° in FIG. 5, compared to FIG. 4. In this FIG. 5, spark plug orifice 48 in the wall of outer body 12 for receiving spark plug 16" is visible for the first time. Again, vanes 38 have moved in FIG. 5, compared to FIG. 4, by sliding in and out relative to the orbiter 32 within their slots 40 near their proximal (closer to the orbiter axis 34) ends, and back and forth along flat surfaces 44 in the inner surface of outer body 12 at their distal (closer to the outer body 12) ends. Also in this FIG. 5, the left side flat outer surface 42 of orbiter 32 is closest to the inside surface of outer body 12, making the "cylinder" space here the minimum value. The engine 10 with the left side "cylinder" space at this point plus with fuel and air compressed therein is in the "chamber 3 firing position" herein.

Figure 6:
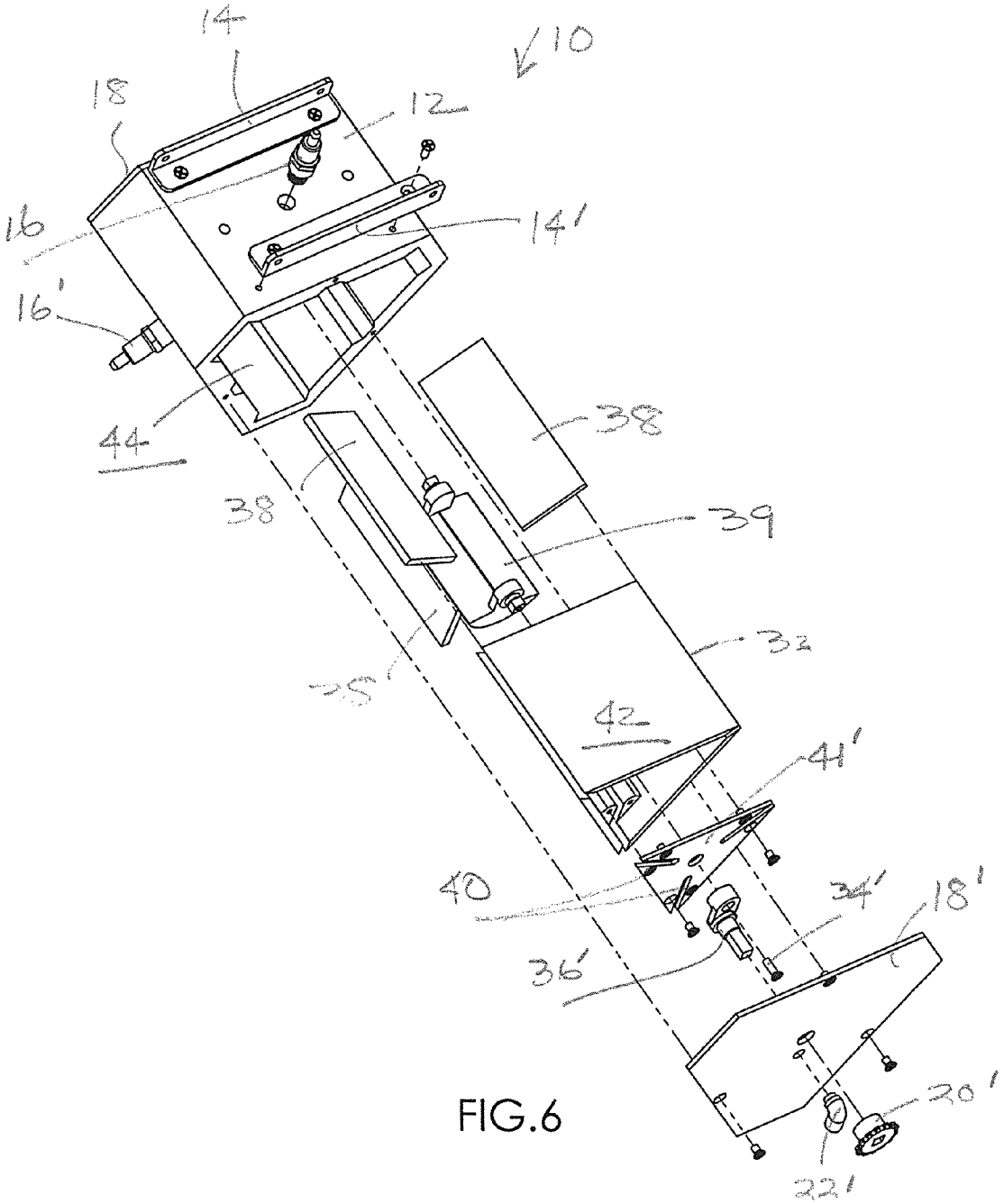
FIG. 6 is a schematic, top, perspective, exploded view of the embodiment depicted in FIGS. 1-5.

FIG. 6 depicts a top, perspective, exploded view of engine 10 with outer body 12, engine mounts 14 and 14' and spark plugs 16 and 16'. Engine 10 end caps 18 and 18', drive sprocket 20' and circulating oil fitting 22' are also shown. Also, FIG. 6 depicts inner orbiter 32 with its center axis 34', crank 36', vanes 38 and counterweight 39. Vanes 38 slide back and forth relative to orbiter 32 in slots 40 of orbiter end plate 41'. FIG. 6 also depicts flat outer surface 42 of orbiter 32, and flat inner surface 44 of outer body 12. Not depicted in FIG. 6 are corresponding axis 34, crank 36 and end plate 41.

Figure 7:
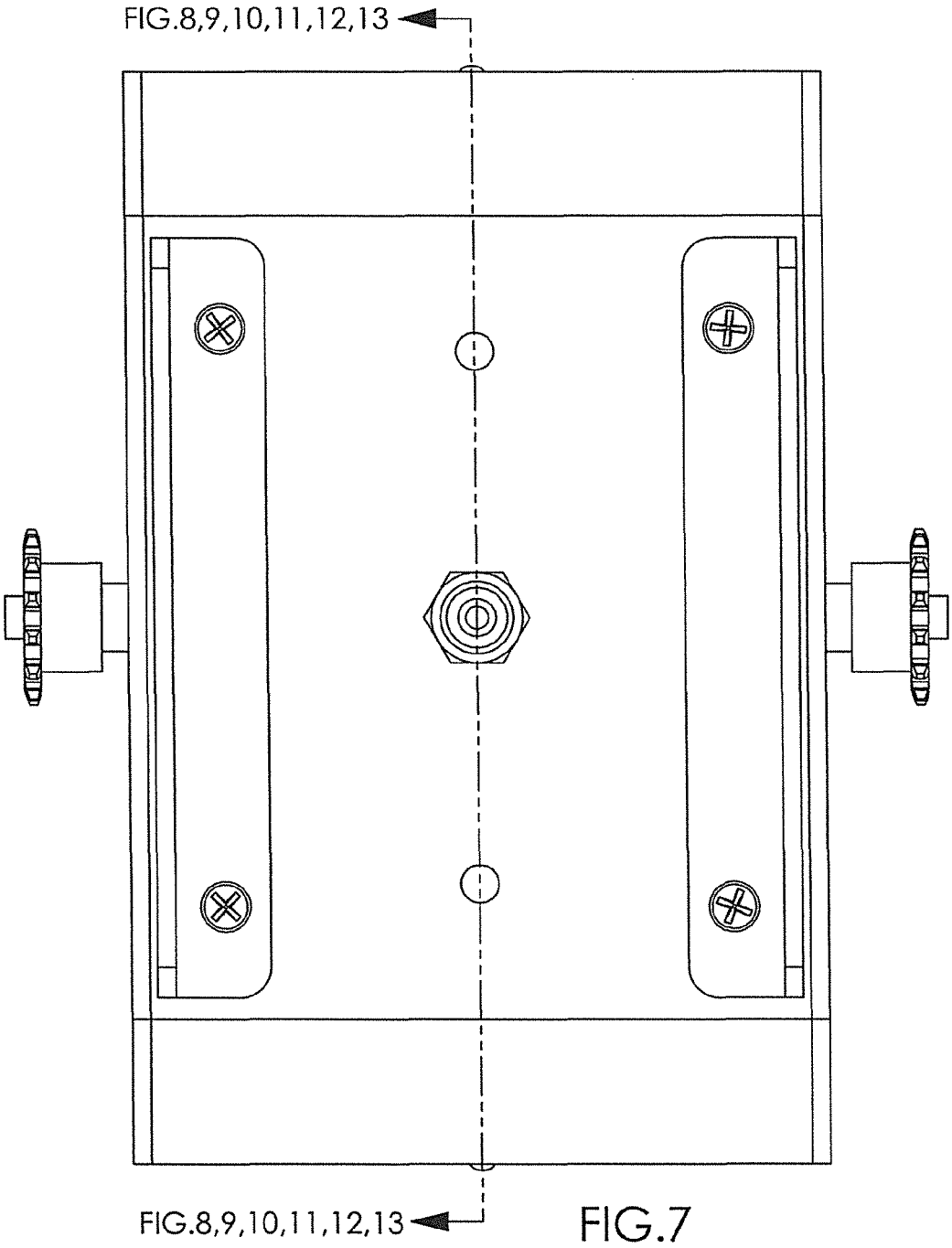
FIG. 7 is a top view of the embodiment depicted in FIG. 1.

FIG. 7 is a top view of engine 10 which is the source of cross-sectional FIGS. 8-13. FIGS. 8-13 sequentially depict the operation of the subject engine in a four-cycle internal combustion operation for two revolutions of the inner orbiter 32 within outer body 12 at 6 points in time. Indicia in FIGS. 8-13 have the following meanings:

I—intake stroke and
C—compression stroke
*—firing of spark plug
P—power stroke following fire
X—exhaust stroke Each of FIGS. 8-13 depict valves through the outer body of the subject engine for controlling flow of liquids and gases into and out from the combustion chambers of engine 10. The valves are open when no horizontal bar is depicted across the valve opening. The valves are closed when the horizontal bar is present. The chambers are numbered in FIGS. 8-13, clockwise from the top of engine 10, as #1, #2, and #3, unless the volume of the chamber during the time for that Figure is at the minimum volume, leaving no room for the number.

Figure 8:
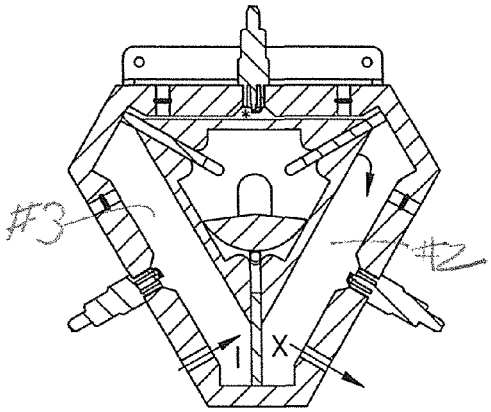
FIGS. 8-13 are six (6) schematic, side, cross-sectional views of the embodiment depicted in FIG. 1, sequentially in time for two revolutions of the internal orbiter along the section lines depicted in FIG. 7.
Figure 9:
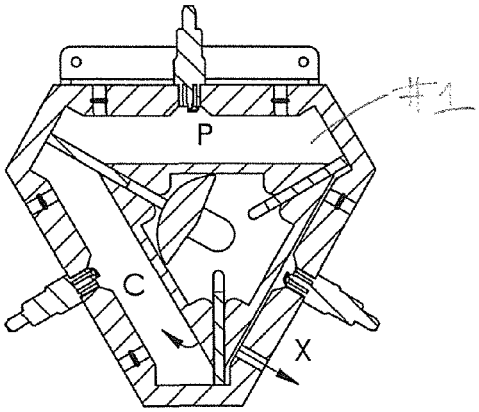
Figure 10:
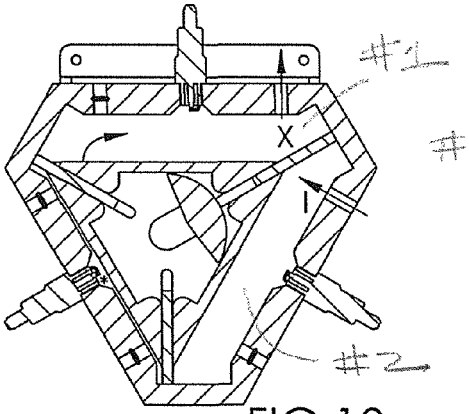
Figure 11:
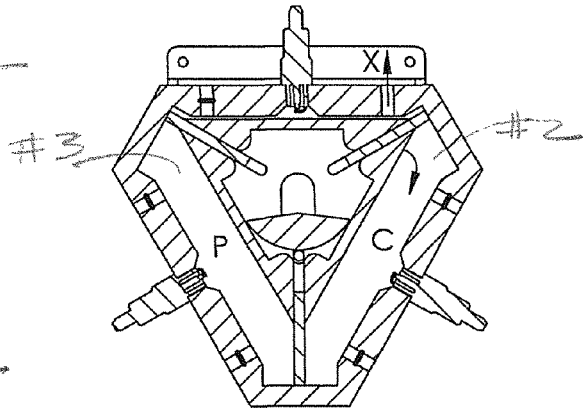
Figure 12:
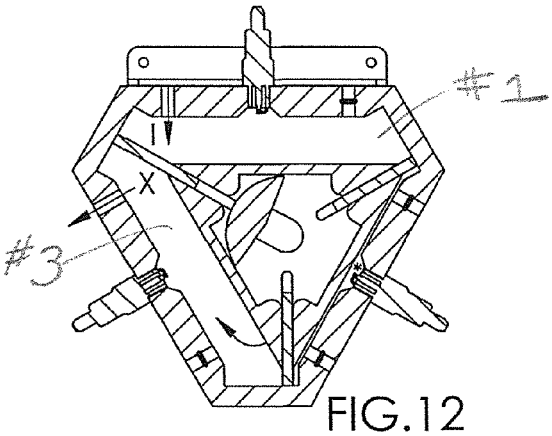
Figure 13:
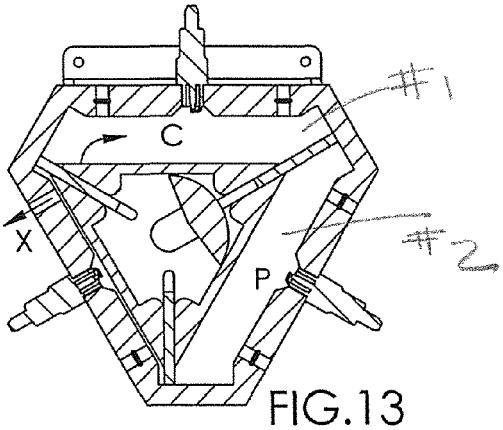

For chamber 1, then:

FIG. 8 depicts the firing of the spark plug;
FIG. 9 depicts the power stroke following fire;
FIG. 10 depicts the start of the exhaust stroke;
FIG. 11 depicts the finish of the exhaust stroke;
FIG. 12 depicts the intake stroke; and
FIG. 13 depicts the compression stroke.

According to this depiction, Chamber 3 fires next after Chamber 1 when Chamber 1 begins the exhaust stroke (FIG. 10). Then, Chamber 2 fires next after Chamber 3 when Chamber 1 performs the intake stroke.

Figure 14:
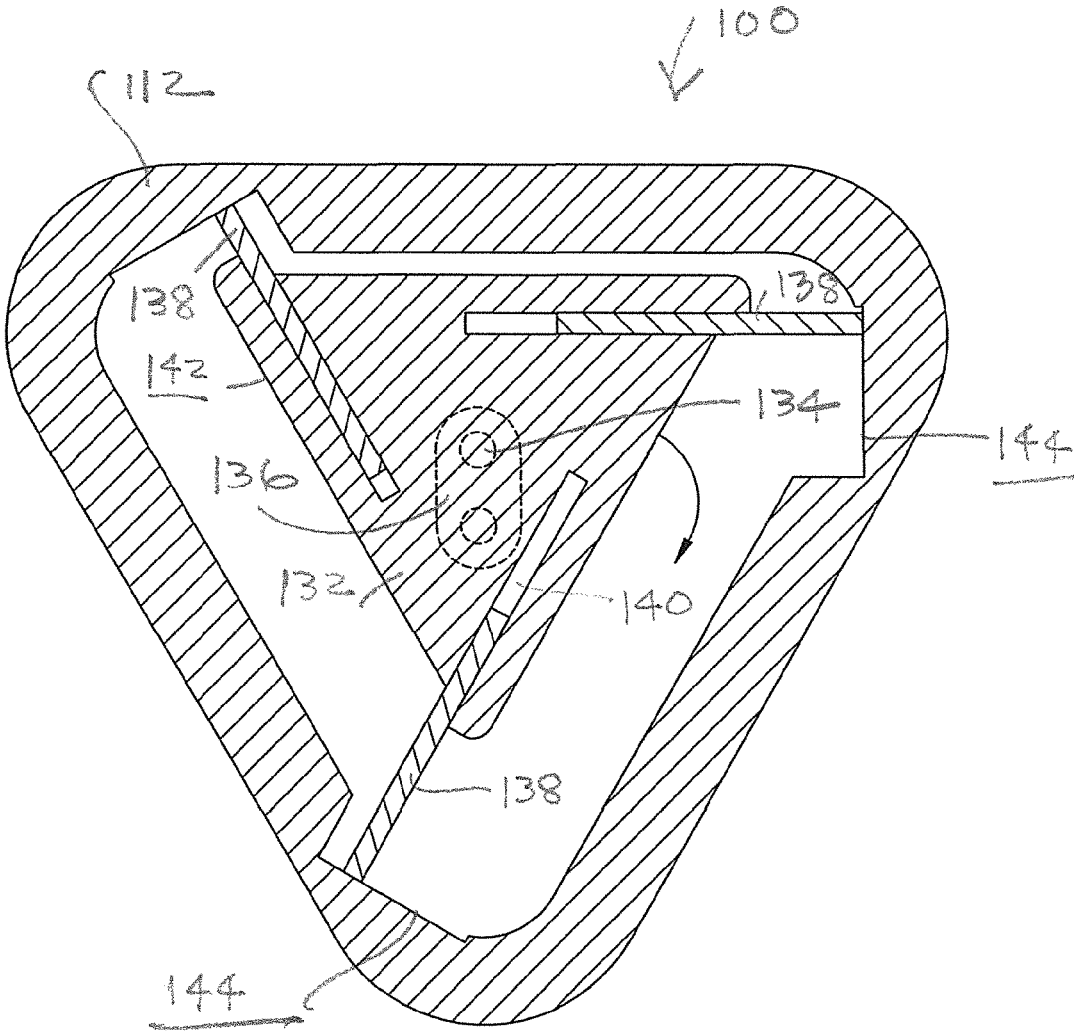
FIG. 14 is a schematic, side, cross-sectional view of an alternative embodiment of the disclosed technology.

FIG. 14 depicts a schematic, side, cross-sectional view of an alternative embodiment 100 of the disclosed technology. Engine 100 has outer body 112, inner orbiter 132 with its center axis 134, crank 136, and vanes 138. Vanes 138 slide back and forth relative to orbiter 132 in slots 140 of orbiter 132. FIG. 7 also depicts flat outer surfaces 142 of orbiter 132, and flat inner surfaces 144 of outer body 112.

Although this disclosed technology has been described above with reference to particular means, materials, and embodiments, it is to be understood that the disclosed technology is not limited to these disclosed particulars, but extends instead to all equivalents within the scope of the following claims.

I claim:

1. An orbital engine with a first outer generally tubular body with two outer body ends and an inside, said first outer body being stationary and having a first axis, a second generally tubular inner body with an outside and a second axis, the second inner body being contained and movable within the stationary first outer body, said first and second axes being parallel, but not colinear, the second inner body having a crank with two ends, one of said two crank ends being connected to the second inner body at the second axis, and the other of said two crank ends extending through one of the two outer body ends and being connected to a drive sprocket at the first axis of the first outer body, there being a plurality of vanes extending in slots generally radially relative to both inner and outer bodies, from the inside of the first outer body to the outside of the second inner body, said vanes and said two outer body ends defining a plurality of chambers in a space between the outside of the inner body and the inside of the outer body, the vanes being slidably movable within the slots and reciprocally movable relative to both the inner and outer bodies, so that rotation of the crank or the drive sprocket results in the orbiting, but not rotation, of the second inner body within the stationary first outer body.

2. The orbital engine of claim 1 wherein the plurality of chambers is an even number.

3. The orbital engine of claim 1 wherein the plurality of chambers is an odd number.

4. The orbital engine of claim 1 wherein the second inner body has two cranks.

5. The orbital engine of claim 4 wherein each of the two cranks is connected to one of two sprockets.

6. The orbital engine of claim 1 wherein the vanes slide in and out of slots in the second inner body, and press against the inside of the first outer body.

7. The orbital engine of claim 1 wherein a chamber has a spark plug.

8. The orbital engine of claim 7 wherein each chamber has a spark plug.

9. The orbital engine of claim 6 wherein the vanes reciprocate on a flat surface on the inside of the first outer body.

10. The orbital engine of claim 1 wherein the vanes do not rotate around the full perimeter of the inside of the first outer body.

* * * * *